US005231719A

United States Patent [19]

Schnelle

[11] Patent Number: 5,231,719

[45] Date of Patent: Aug. 3, 1993

[54] OPERATING TABLE WITH REMOVABLE PATIENT SUPPORT SURFACE MEANS

[75] Inventor: Eberhard Schnelle, Rastatt, Fed. Rep. of Germany

[73] Assignee: Stierlen-Maquet AG, Rastatt, Fed. Rep. of Germany

[21] Appl. No.: 977,914

[22] Filed: Nov. 18, 1992

[30] Foreign Application Priority Data

Nov. 21, 1991 [DE] Fed. Rep. of Germany ..... 4138318

[51] Int. Cl.[5] ..... A61G 13/00

[52] U.S. Cl. ..... 5/614; 5/618; 5/620

[58] Field of Search ..... 5/614, 617, 618, 620, 5/613

[56] References Cited

U.S. PATENT DOCUMENTS

| | | | |
|---|---|---|---|
| 3,362,704 | 1/1968 | Pilz | 5/620 X |
| 3,868,103 | 2/1975 | Pageot et al. | 5/614 |
| 3,896,704 | 7/1975 | Barud et al. | 5/618 X |
| 3,977,664 | 8/1976 | Mitchell et al. | 5/614 |
| 4,186,917 | 2/1980 | Rais et al. | 5/614 |
| 4,195,829 | 4/1980 | Reser | 5/614 |
| 4,225,125 | 9/1980 | Lee | 5/614 |
| 4,501,414 | 2/1985 | Mason et al. | 5/618 X |
| 4,589,642 | 5/1986 | Schnelle et al. | 5/614 |
| 4,865,303 | 9/1989 | Hall | 5/618 X |

*Primary Examiner*—Michael F. Trettel

[57] ABSTRACT

An operating table with a support column (12) and a patient support surface means (14) removably mounted on the column, which patient support means includes a base section (16) releasably connectable with the support column (12) and at least one further support surface providing section (18, 20) pivotally connected with the base section (16), which further section is pivotally movable by means of a drive mechanism relative to the base section (16), the operating table being so designed that the drive mechanism has at least one pressure medium actuatable positioning cylinder (26) and that a pressure medium pump (30) for actuating the positioning cylinder (26) is arranged on the patient support surface means (14).

5 Claims, 1 Drawing Sheet

OPERATING TABLE WITH REMOVABLE PATIENT SUPPORT SURFACE MEANS

Figure 1:
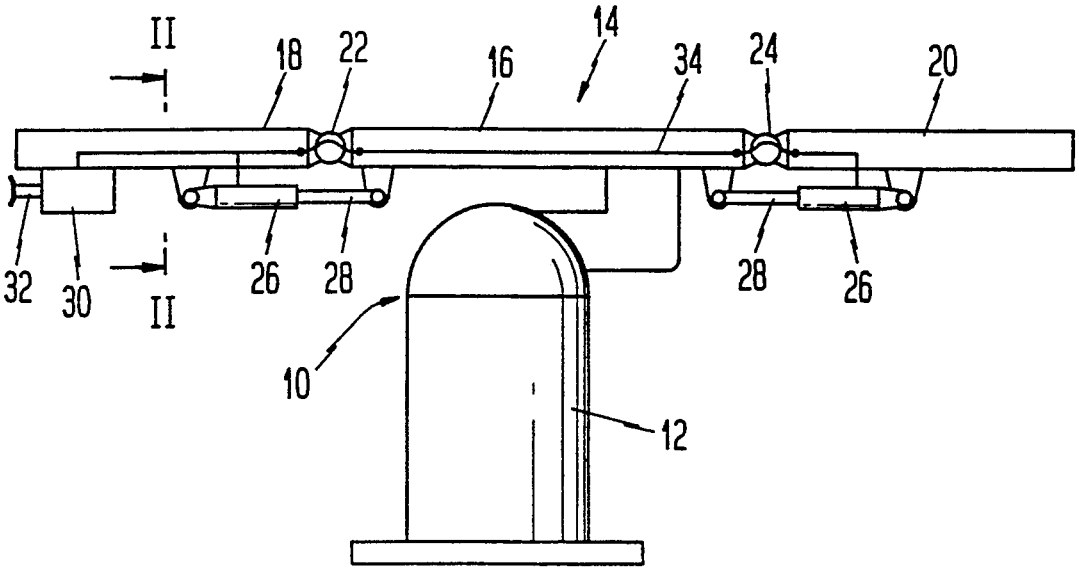

The invention concerns an operating table with a support column and a patient support surface means removably mounted on the column, which means includes a base section releasably connected to the support column and at least one further support surface providing section pivotally connected to the base section and pivotally movable relative to the base section by a drive mechanism.

One such operating table is for example known from German Patent No. 1,196,815. In this known arrangement, in order on one hand to obtain motorized adjustability of the support surface sections relative to one another and on the other hand to guarantee that the patient support surface means can be removed entirely from the support column, it is proposed that the individual support surface sections be mechanically adjustable through a gear mechanism, with the positioning motors being arranged in the support column and with gear mechanism parts inside the patient support surface means being capable of being coupled with the positioning motors in the support column through coupling elements on the support surface means and on the support column, which upon plaoement of the patient support means onto the support column come into cooperating engagement with one another. Such mechanical couplings are extremely expensive, if they are so presented as to be suited to use in an operating room having high requirements as to sterilization and functional reliability of the arrangement. Moreover, this solution raises the disadvantage that the individual support surface providing sections of the patient support surface means can only be adjusted by a motor when the patient support surface means rests on the support column.

From German Patent No. 2,509,104 it is already known, in an operating table with a patient support surface means removable from the support column, to adjust the patient support surface means in a horizontal plane relative to the support column with the help of air pressure motors. The air pressure motors in this case are connected with a pressurized air source arranged inside of the operating room or at a central location for the entire hospital, with the connection of the air pressure motors with the air pressure source being made by pressurized air couplings provided at the location of the connection between the patient support surface means and the support column. In this solution the problem also arises that the couplings and the conductor closures be so provided that they fulfill the requirements of the sterile operating room environment. Further, this solution has the disadvantage that an adjustment of the sections of the patient support surface means can only take place when the patient support surface means rests on the support column.

The invention has as its object the provision of an operating table of the previously described kind whereby an easy adjustment of the sections of the patient support surface means is possible also independently from the support column.

This object is solved in accordance with the invention in that the drive mechanism has at least one pressure medium actuatable positioning cylinder and in that a pressure medium pump for actuating the positioning cylinder is arranged on the patient support surface means.

With the solution of the invention the patient support surface forming sections can now also be adjusted when the patient support surface means has been removed from the support column. Moreover, because of the absence of all coupling locations between the patient support surface means and the support column the problem of the sterilizability of the operating table can be overcome.

In order to make the arrangement as simple as possible and to be independent of an energy source, preferably a pressure medium pump is used which is manually actuatable. Practically the pressure medium pump is arranged on a patient support section forming the support for the back of the patient, so that it can be easily accessed by the operating personnel and is not disturbed when the patient support surface means is placed onto the support column.

In a very simple construction of the pressure medium pump the pressure can be created by means of a plunger movement with a valve being arranged in the conductor between the pressure space of the pressure medium pump and the positioning cylinder, which valve is opened by a pressure creating movement of the plunger. The pressure medium pump can also be provided with a double check valve.

Figure 2:
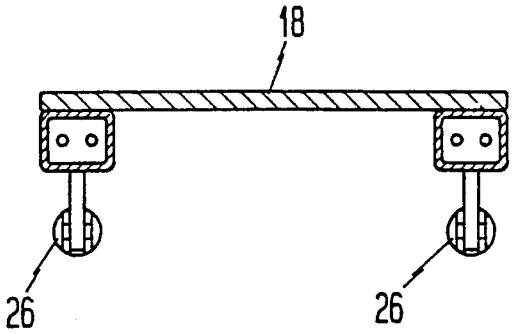
Figure 3:
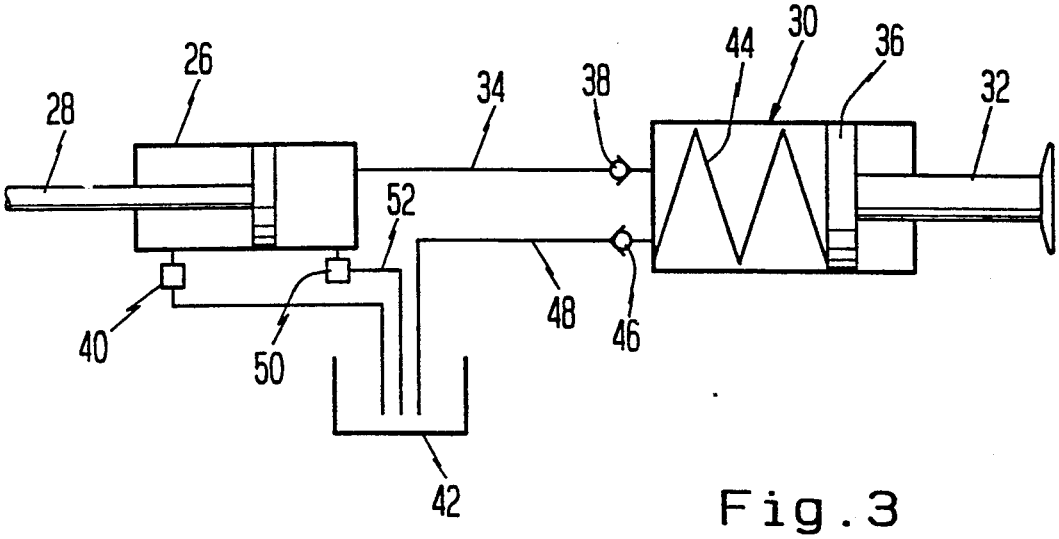

Further features and advantages of the invention are apparent from the following description which in combination with the accompanying drawings explain the invention with respect to an exemplary embodiment. The drawings are:

FIG. 1 A schematic side view of an operating table embodying the invention,

FIG. 2 A schematic section through the patient support surface means taken along the line II—II of FIG. 1, and FIG. 3 A schematic representation of the hydraulic circuit for actuating one of the positioning cylinders.

The operating table 10 illustrated in FIG. 1 includes a supporting column 12, on which a patient support surface means, indicated generally at 14, is removably held, as is for example described in German Patent No. 1,196,815. For further details of the mounting of the patient support surface means 14 onto the support column 12 reference is made to this patent.

The patient support surface means includes, in the illustrated embodiment, a middle or base section 16 to the two longitudinal ends of which a back section 18 and a foot section 20 are pivotally connected for movement about horizontal axes 22 and 24, respectively. In each case a hydraulic positioning cylinder 26 serves to provide pivotal movement with its cylinder portion being connected to the associated back section 18 or foot section 20 and with its piston rod 28 being connected to the middle section 16. A pump indicated generally at 30, which can be manually actuated by means of a plunger 32, serves to create pressure. The pump is connected with the associated positioning cylinder 26 by conductors 34. As FIG. 2 shows, the conductors 34 are lead through the side beams, made from hollow profile members, of the support surface sections 16, 18 and 20.

As FIG. 3 shows, upon a pressurizing movement of the plunger 32, and in the pump of a piston 36 connected with the plunger, a first check valve 38 is opened, so that hydraulic fluid can flow through the pressure conductors 34 to the pressure space of the positioning cylinder 26. Pressure fluid from the cylinder space on the piston rod side of the piston flows through a check valve 40 to a tank 42. The plunger 32 is transported rearwardly toward its beginning position (in FIG. 3 toward the right) by a spring 44, whereupon the check valve 38 closes and a check valve 46 operating in the reverse direction opens, which creates a connection between the pressure space of the pump and the tank through a conductor 48. In this way pressure fluid from the tank 42 can be sucked into the pressure space of the pump 30. In the precedingly described movement the piston of the positioning cylinder 26 is moved to the left in FIG. 3. The movement in the reverse direction takes place in that a valve 50 in a conductor 52 is opened, which connects the cylinder space on the non-piston rod side of the piston with the tank 42 so that the piston under the effect of the load connected to its piston rod is driven to the right in FIG. 3, whereupon fluid is sucked from the tank 42. The tank 42 can be made from an elastically expandable tube.

I claim:

1. An operating table with a support column (12) and a patient support surface means (14) releasably mounted on it, which patient support surface means includes a base section (16) releasably connected with the support column (12) and at least one further support surface providing section (18) pivotally connected to the base section, which further seotion is pivotal relative to the base section by means of a drive mechanism, characterized in that the drive mechanism has at least one pressure medium actuated positioning cylinder (26) and that a pressure medium pump (30) for actuating the pressure cylinder (26) is arranged on the patient support surface means (14).

2. An operating table according to claim 1 further characterized in that the pressure medium pump (30) is manually actuatable.

3. An operating table according to claim 2 further characterized in that in the manually actuatable pressure medium pump (30) the pressure is created by movement of a plunger, with a valve (38) being arranged in the conductors (34) between the pressure space of the pressure medium pump (30) and the positioning cylinder (26), which valve is opened by a pressure creating movement of the plunger.

4. An operating table according to claim 3 further characterized in that the pressure medium pump (30) is provided with a double check valve.

5. An operating table according to claim 1 further characterized in that the pressure medium pump (30) is arranged on the support surface providing section (18) which forms the support for the back of a patient.

* * * * *